US011108142B2

(12) United States Patent
Wang et al.

(10) Patent No.: US 11,108,142 B2
(45) Date of Patent: Aug. 31, 2021

(54) ANTENNA, TRANSMITTING ANTENNA, RECEIVING ANTENNA AND WIRELESS COMMUNICATION DEVICE

(71) Applicant: Tyco Electronics (Shanghai) Co. Ltd., Shanghai (CN)

(72) Inventors: Shaoyong Wang, Shanghai (CN); Yuming Song, Shanghai (CN); Yuan Zhong, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 64 days.

(21) Appl. No.: 16/725,334

(22) Filed: Dec. 23, 2019

(65) Prior Publication Data

US 2020/0203816 A1 Jun. 25, 2020

(30) Foreign Application Priority Data

Dec. 25, 2018 (CN) ..... 201811589911.7

(51) Int. Cl.

| | |
|---|---|
| ***H01Q 1/36*** | (2006.01) |
| ***H01Q 1/50*** | (2006.01) |
| ***H01Q 1/38*** | (2006.01) |
| ***H01Q 7/00*** | (2006.01) |
| ***H01Q 21/00*** | (2006.01) |
| ***H01Q 9/28*** | (2006.01) |

(52) U.S. Cl.

CPC ..... *H01Q 1/36* (2013.01); *H01Q 1/38* (2013.01); *H01Q 1/50* (2013.01); *H01Q 7/00* (2013.01); *H01Q 9/285* (2013.01); *H01Q 21/00* (2013.01)

(58) Field of Classification Search

CPC ..... H01Q 1/36; H01Q 1/50; H01Q 21/00; H01Q 1/38; H01Q 9/285; H01Q 7/00

USPC ..... 343/895

See application file for complete search history.

(56) References Cited

U.S. PATENT DOCUMENTS

| | | | | |
|---|---|---|---|---|
| 4,160,978 | A * | 7/1979 | DuHamel | H01Q 7/00 343/732 |
| 5,917,454 | A * | 6/1999 | Hill | H01Q 13/12 343/769 |
| 2014/0240581 | A1* | 8/2014 | Sung | G03B 17/02 348/335 |
| 2016/0344240 | A1* | 11/2016 | Yeh | A61N 1/3605 |
| 2018/0026375 | A1* | 1/2018 | Wang | H01Q 9/26 343/803 |
| 2019/0140334 | A1* | 5/2019 | Tkadlec | H01P 1/062 |

* cited by examiner

*Primary Examiner* — Hai V Tran

(74) *Attorney, Agent, or Firm* — Barley Snyder

(57) ABSTRACT

An antenna includes a cylindrical substrate, an arc-shaped outer metal strip formed on an outer surface of the cylindrical substrate, and an arc-shaped inner metal strip formed on an inner surface of the cylindrical substrate. A cross section of the cylindrical substrate forms a complete circle with a center angle equal to 360 degrees or forms an arc with a center angle less than 360 degrees. The cylindrical substrate, the arc-shaped outer metal strip, and the arc-shaped inner metal strip have a common central axis.

20 Claims, 9 Drawing Sheets

ANTENNA, TRANSMITTING ANTENNA, RECEIVING ANTENNA AND WIRELESS COMMUNICATION DEVICE

CROSS-REFERENCE TO RELATED APPLICATION

This application claims the benefit of the filing date under 35 U.S.C. § 119(a)-(d) of Chinese Patent Application No. 201811589911.7, filed on Dec. 25, 2018.

FIELD OF THE INVENTION

The present invention relates to a wireless communication device and, more particularly, to an antenna of a wireless communication device.

BACKGROUND

Antennas commonly used in smart home appliances or devices comprise dipole antennas, inverted F antennas, and other types of antennas. These antennas are simple in structure and high in efficiency. These antennas can be suitable for far-field communication ($R>>2D^2/\lambda$, wherein R is a distance between two antennas for transmitting signals to each other, D is a maximum external dimension of the antenna, and $\lambda$, is a working wavelength of the antenna). With the current wide application of wireless power supply technology in the field of smart home appliances, the demand for short-distance communication with high-speed transmission rate and low far-field radiation leakage is increasing.

An NFC antenna may be used for short-distance communication, and its far-field radiation power is low, but because of its low working frequency and narrow band, it cannot achieve high-speed communication. In addition, the above antennas are usually used for communication in the static state. When two antennas need to be rotated mutually (for example, one antenna is installed on a wireless HD camera with wireless power supply, the two antennas will need to be rotated with respect to each other), because the dipole/inverted F antenna is a linearly polarized antenna, the distance between the two antennas often changes greatly during rotation, and the intensity of the signal received by the antenna also changes dramatically during rotation.

Signal intensity and quality are usually guaranteed by increasing transmission power. However, increasing the transmission power will cause the communication signal to leak into the surrounding environment, which is easy to be eavesdropped by others, reducing the safety and confidentiality of communication. Therefore, the existing antenna is not suitable for security equipment with strict anti-eavesdropping requirements.

SUMMARY

An antenna includes a cylindrical substrate, an arc-shaped outer metal strip formed on an outer surface of the cylindrical substrate, and an arc-shaped inner metal strip formed on an inner surface of the cylindrical substrate. A cross section of the cylindrical substrate forms a complete circle with a center angle equal to 360 degrees or forms an arc with a center angle less than 360 degrees. The cylindrical substrate, the arc-shaped outer metal strip, and the arc-shaped inner metal strip have a common central axis.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
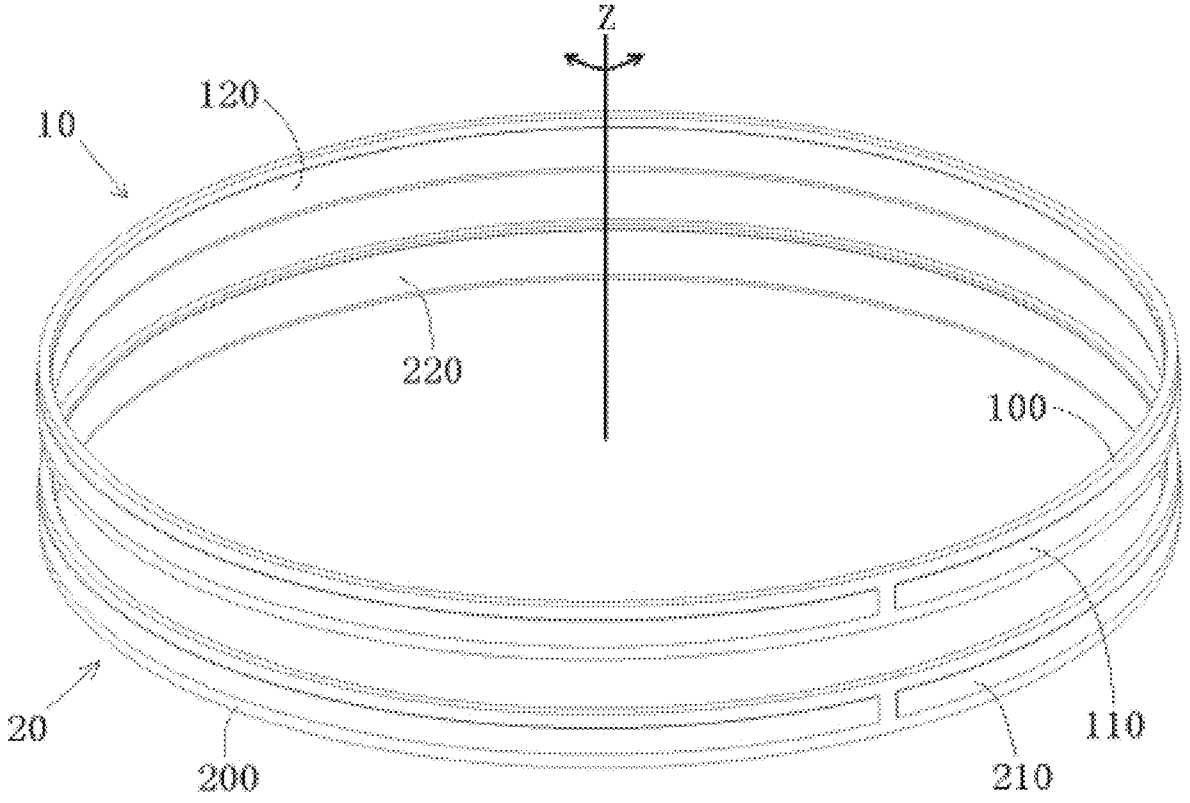
FIG. 1 is a perspective view of a wireless communication device according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A wireless communication device, as shown in FIG. 1, comprises a transmitting antenna 10 and a receiving antenna 20. The transmitting antenna 10 and the receiving antenna 20 are arranged to have a common central axis Z. The transmitting antenna 10 and the receiving antenna 20 are axially spaced by a predetermined distance. At least one of the transmitting antenna 10 and the receiving antenna 20 is provided to rotate freely around the common central axis Z.

As shown in FIG. 1, an outer diameter of the transmitting antenna 10 is substantially equal to an outer diameter of the receiving antenna 20, and an inner diameter of the transmitting antenna 10 is substantially equal to an inner diameter of the receiving antenna 20. In other embodiments, the outer diameter of the transmitting antenna 10 may be slightly smaller or slightly larger than the outer diameter of the receiving antenna 20, and the inner diameter of the transmitting antenna 10 may be slightly smaller or slightly larger than the inner diameter of the receiving antenna 20.

Figure 2:
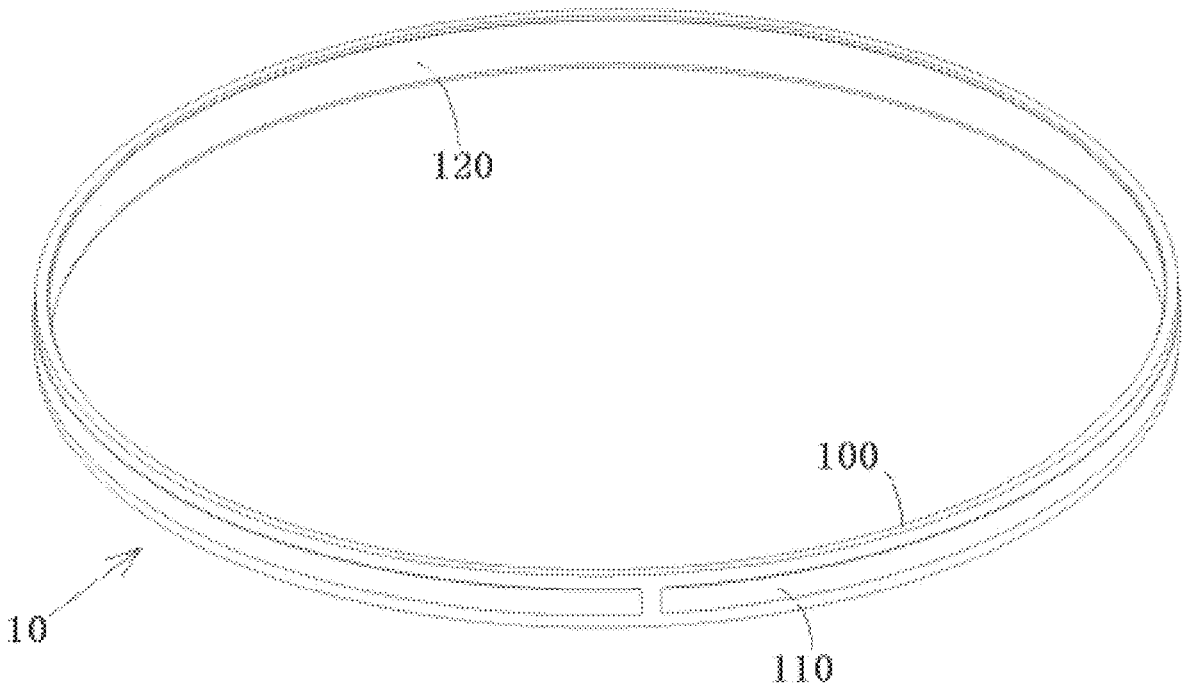
FIG. 2 is a perspective view of a transmitting antenna of the wireless communication device of FIG. 1.
Figure 3:
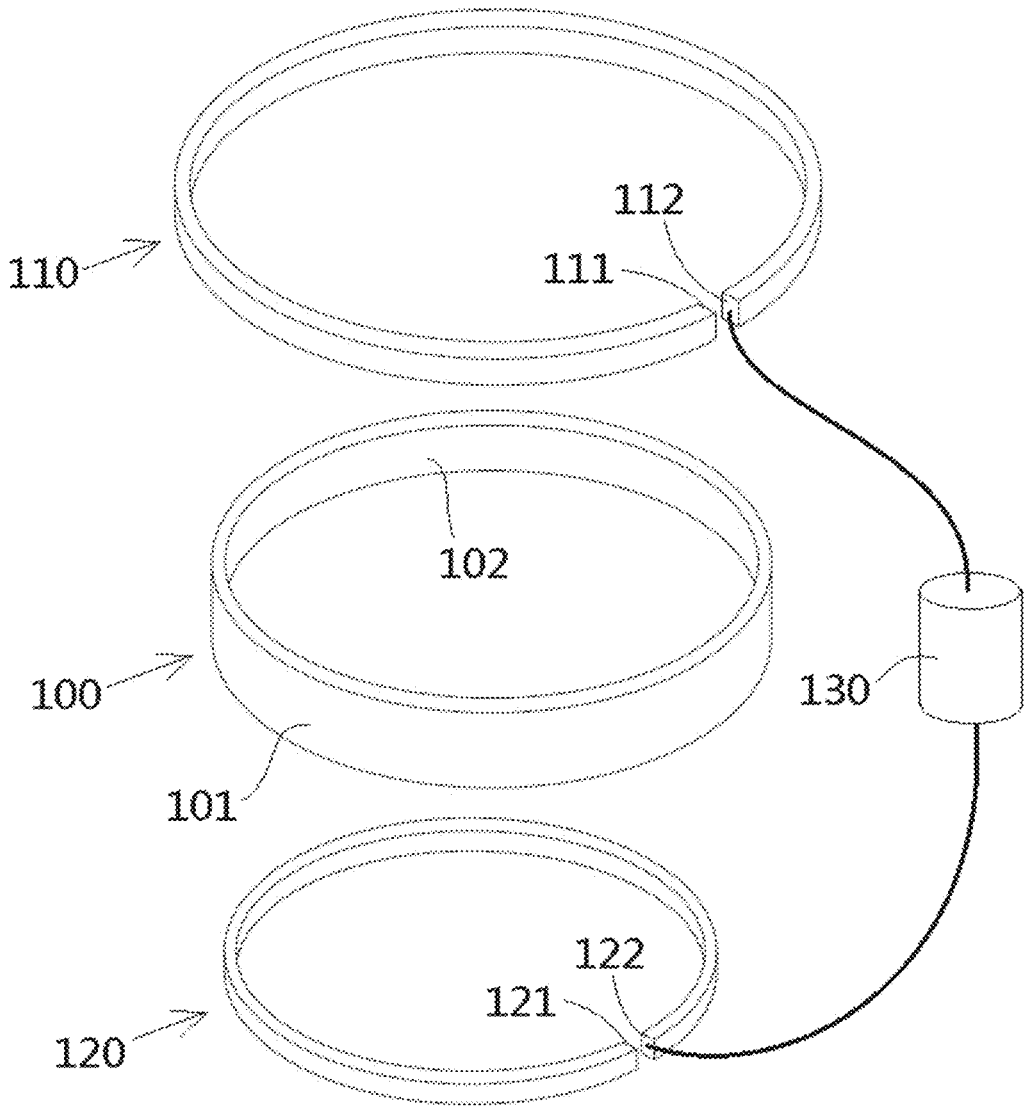
FIG. 3 is an exploded perspective view of the transmitting antenna of FIG. 2.

The transmitting antenna 10, as shown in FIGS. 1-3, comprises a first cylindrical substrate 100, a first arc-shaped outer metal strip 110, and a first arc-shaped inner metal strip 120. The cross section of the first cylindrical substrate 100 is formed as a complete circle with a center angle equal to 360 degrees. The first arc-shaped outer metal strip 110 is formed on an outer surface 101 of the first cylindrical substrate 100. The first arc-shaped inner metal strip 120 is formed on an inner surface 102 of the first cylindrical substrate 100.

As shown in FIGS. 1-3, in an embodiment, the first cylindrical substrate 100, the first arc-shaped outer metal strip 110, and the first arc-shaped inner metal strip 120 have a common central axis Z. A first end 111 of the first arc-shaped outer metal strip 110 is configured to electrically connect to one of an outer conductor and an inner conductor of a first radio frequency ("RF") coaxial cable (not shown), and a second end 112 of the first arc-shaped outer metal strip 110 is configured to electrically connect to a first end of a first RF resistance 130. A first end 121 of the first arc-shaped inner metal strip 120 is configured to electrically connect to the other of the outer conductor and the inner conductor of the first RF coaxial cable, and a second end 122 of the first arc-shaped inner metal strip 120 is configured to electrically connect to a second end of the first RF resistance 130.

In an exemplary embodiment, the first cylindrical substrate 100 is made of a medium material, the first arc-shaped outer metal strip 110 and the first arc-shaped inner metal strip 120 each may be configured to be a metal microstrip transmission line printed on the medium material. For example, as shown FIGS. 1-3, in an embodiment, the first cylindrical substrate 100 is configured to be a circuit board, the first arc-shaped outer metal strip 110 and the first arc-shaped inner metal strip 120 each is configured to be a metal microstrip transmission line printed on the circuit board.

As shown in FIGS. 1-3, in an embodiment, the center angle of the first arc-shaped outer metal strip 110 is substantially equal to that of the first arc-shaped inner metal strip 120. In an embodiment, a distance between two ends 111, 112 of the first arc-shaped outer metal strip 110 is within a range of 1 mm~5 mm. A distance between two ends 121, 122 of the first arc-shaped inner metal strip 120 is within a range of 1 mm~5 mm.

As shown in FIGS. 1-3, one of the first arc-shaped outer metal strip 110 and the first arc-shaped inner metal strip 120 acts as a first radio frequency ground line, and the other of the first arc-shaped outer metal strip 110 and the first arc-shaped inner metal strip 120 acts as a first radio frequency signal line. An end of the first radio frequency ground line is configured to electrically connect to an outer conductor of a first RF coaxial cable, and an end of the first radio frequency signal line is configured to electrically connect to an inner conductor of the first RF coaxial cable.

In the embodiment shown in FIGS. 1-3, the first arc-shaped outer metal strip 110 is used as the first radio frequency ground line, and the first arc-shaped inner metal strip 120 is used as the first radio frequency signal line. The width of the first radio frequency ground line is larger than that of the first radio frequency signal line. In an embodiment, the width of the first radio frequency ground line may be larger than 3 mm, and the width of the first radio frequency signal line may be less than 3 mm. In an exemplary embodiment, the first radio frequency ground line and the first radio frequency signal line each are configured to be a metal microstrip transmission line with a characteristic impedance of 50 ohms which is formed on the first cylindrical substrate 100.

In the embodiment shown in FIGS. 1-3, the transmitting antenna 10 is configured to be a Near Field Communication antenna.

Figure 4:
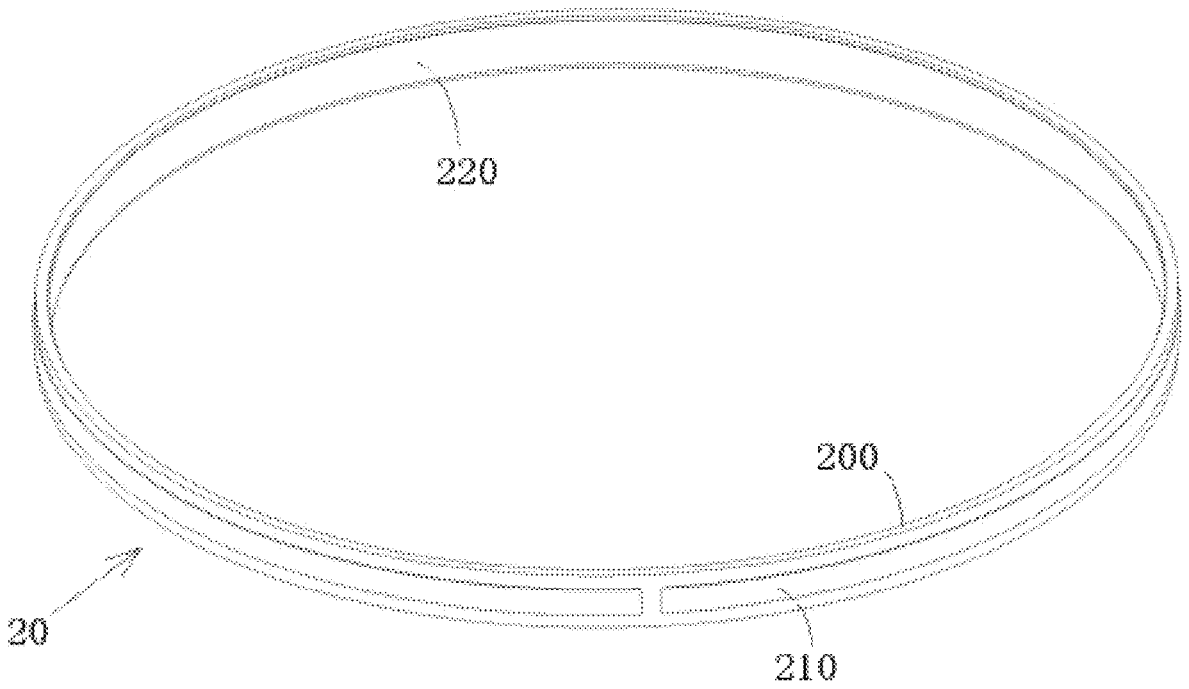
FIG. 4 is a perspective view of a receiving antenna of the wireless communication device of FIG. 1.
Figure 5:
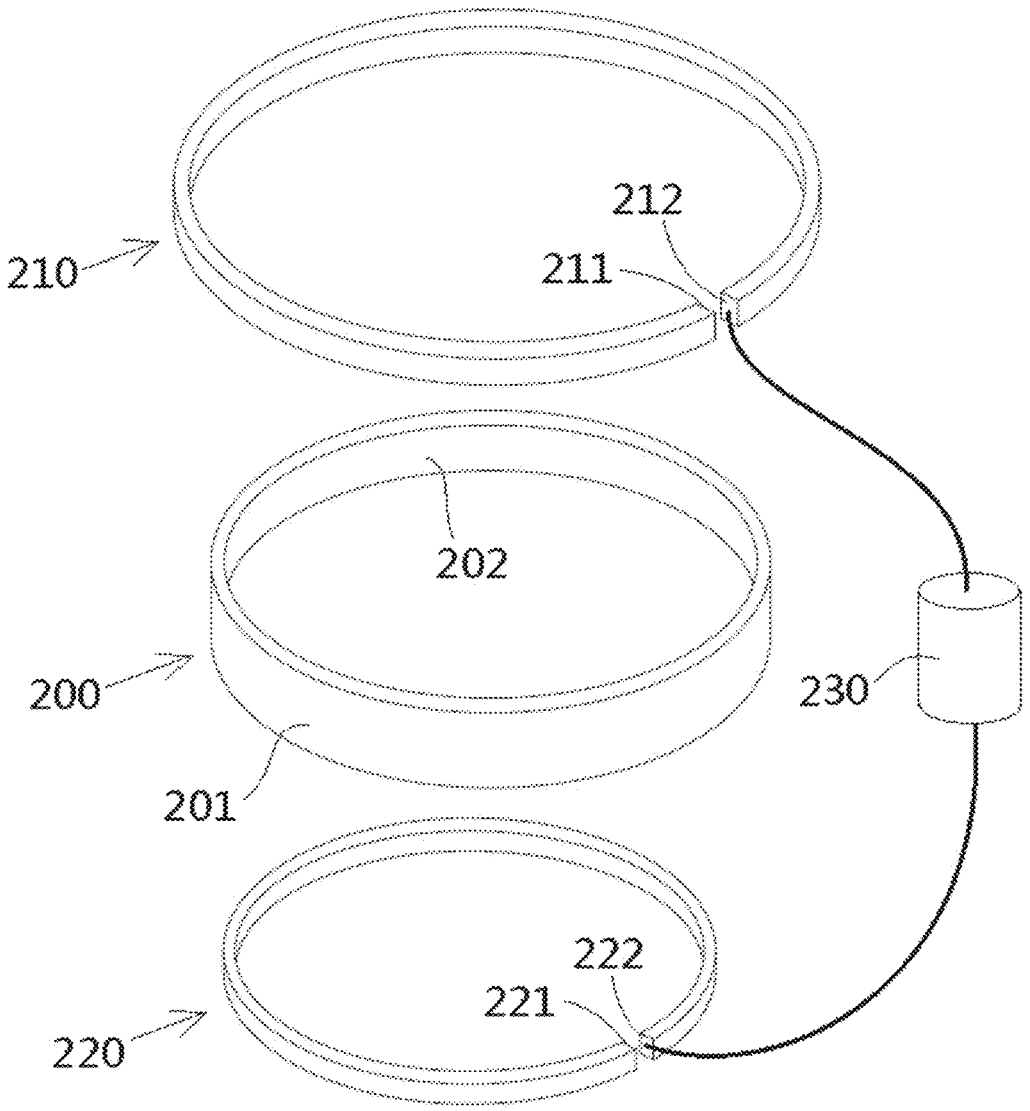
FIG. 5 is an exploded perspective view of the receiving antenna of FIG. 4.

As shown in FIGS. 1, 4, and 5, the receiving antenna 20 has a second cylindrical substrate 200, a second arc-shaped outer metal strip 210, and a second arc-shaped inner metal strip 220. The cross section of the second cylindrical substrate 200 is formed as a complete circle with a center angle equal to 360 degrees. The second arc-shaped outer metal strip 210 is formed on an outer surface 201 of the second cylindrical substrate 200. The second arc-shaped inner metal strip 220 is formed on an inner surface 202 of the second cylindrical substrate 200.

As shown in FIGS. 1, 4, and 5, in an embodiment, the center angle of the second arc-shaped outer metal strip 210 is substantially equal to the center angle of the second arc-shaped inner metal strip 220. In an embodiment, the second cylindrical substrate 200, the second arc-shaped outer metal strip 210, and the second arc-shaped inner metal strip 220 have a common central axis Z.

As shown in FIGS. 1, 4, and 5, in an embodiment, a first end 211 of the second arc-shaped outer metal strip 210 is configured to electrically connect to one of an outer conductor and an inner conductor of a second RF coaxial cable, and a second end 212 of the second arc-shaped outer metal strip 210 is configured to electrically connect to a first end of a second RF resistance 230. A first end 221 of the second arc-shaped inner metal strip 220 is configured to electrically connect to the other of the outer conductor and the inner conductor of the second RF coaxial cable, and a second end 222 of the second arc-shaped inner metal strip 220 is configured to electrically connect to a second end of the second RF resistance 230.

In the embodiment shown in FIGS. 1, 4, and 5, the second cylindrical substrate 200 is configured to be a circuit board, and the second arc-shaped outer metal strip 210 and the second arc-shaped inner metal strip 220 are each configured to be a metal microstrip transmission line printed on the circuit board. In an embodiment, a distance between two ends 211, 212 of the second arc-shaped outer metal strip 210 is within a range of 1 mm~5 mm. A distance between two ends 221, 222 of the second arc-shaped inner metal strip 220 is within a range of 1 mm~5 mm.

In an embodiment, one of the second arc-shaped outer metal strip 210 and the second arc-shaped inner metal strip 220 is used as a second radio frequency ground line, and the other of the second arc-shaped outer metal strip 210 and the second arc-shaped inner metal strip 220 is used as a second radio frequency signal line. An end of the second radio frequency ground line is configured to electrically connect to the outer conductor of a second RF coaxial cable, and an end of the second radio frequency signal line is configured to electrically connect to the inner conductor of the second RF coaxial cable.

In the embodiment shown in FIGS. 1, 4, and 5, the second arc-shaped outer metal strip 210 is used as the second radio frequency ground line, and the second arc-shaped inner metal strip 220 is used as the second radio frequency signal line. The width of the second radio frequency ground line is larger than the width of the second radio frequency signal line. In an exemplary embodiment, the width of the second radio frequency ground line may be larger than 3 mm, and the width of the second radio frequency signal line may be less than 3 mm. In an exemplary embodiment, the second radio frequency ground line and the second radio frequency signal line are each a metal microstrip transmission line with a characteristic impedance of 50 ohms which is formed on the second cylindrical substrate 200.

In the embodiment shown in FIGS. 1, 4, and 5, the receiving antenna 20 is configured to be a Near Field Communication antenna.

As shown FIGS. 1-5, the center angle of the first arc-shaped outer metal strip 110 and the first arc-shaped inner metal strip 120 on the transmitting antenna 10 is substantially equal to the center angle of the second arc-shaped outer metal strip 210 and the second arc-shaped inner metal strip 220 on the receiving antenna 20. The center angle of the first arc-shaped outer metal strip 110 and the first arc-shaped inner metal strip 120 is larger than 300 degrees and less than 360 degrees. In various embodiments, the center angle of the first arc-shaped outer metal strip 110 and the first arc-shaped inner metal strip 120 may be substantially equal to 340 degrees, 345 degrees, 350 degrees, or 355 degrees. The center angle of the second arc-shaped outer metal strip 210 and the second arc-shaped inner metal strip 220 is larger than 300 degrees and less than 360 degrees. In various embodiments, the center angle of the second arc-shaped outer metal strip 210 and the second arc-shaped inner metal strip 220 may be substantially equal to 340 degrees, 345 degrees, 350 degrees, or 355 degrees.

Figure 6:
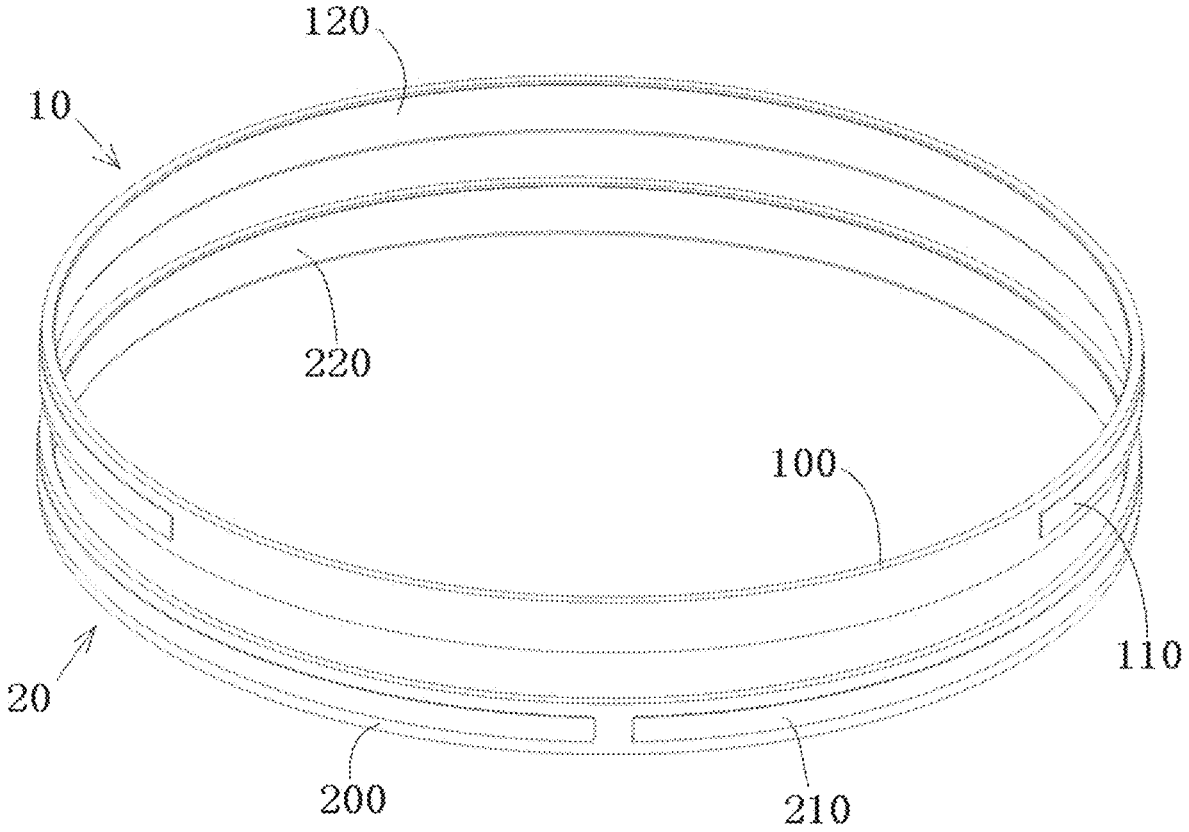
FIG. 6 is a perspective view of a wireless communication device according to another embodiment.

A wireless communication device according to another embodiment is shown in FIG. 6. The main difference between the wireless communication device of the embodiment shown in FIG. 6 and the wireless communication device of the embodiment shown in FIGS. 1-5 is that the center angle of the first arc-shaped outer metal strip 110 and the first arc-shaped inner metal strip 120 on the transmitting antenna 10 is not equal to the center angle of the second arc-shaped outer metal strip 210 and the second arc-shaped inner metal strip 220 on the receiving antenna 20.

As shown in FIG. 6, the center angle of the first arc-shaped outer metal strip 110 and the first arc-shaped inner metal strip 120 on the transmitting antenna 10 is less than the center angle of the second arc-shaped outer metal strip 210 and the second arc-shaped inner metal strip 220 on the receiving antenna 20. In other embodiments, the center angle of the first arc-shaped outer metal strip 110 and the first arc-shaped inner metal strip 120 on the transmitting antenna 10 may be larger than the center angle of the second arc-shaped outer metal strip 210 and the second arc-shaped inner metal strip 220 on the receiving antenna 20.

Figure 7:
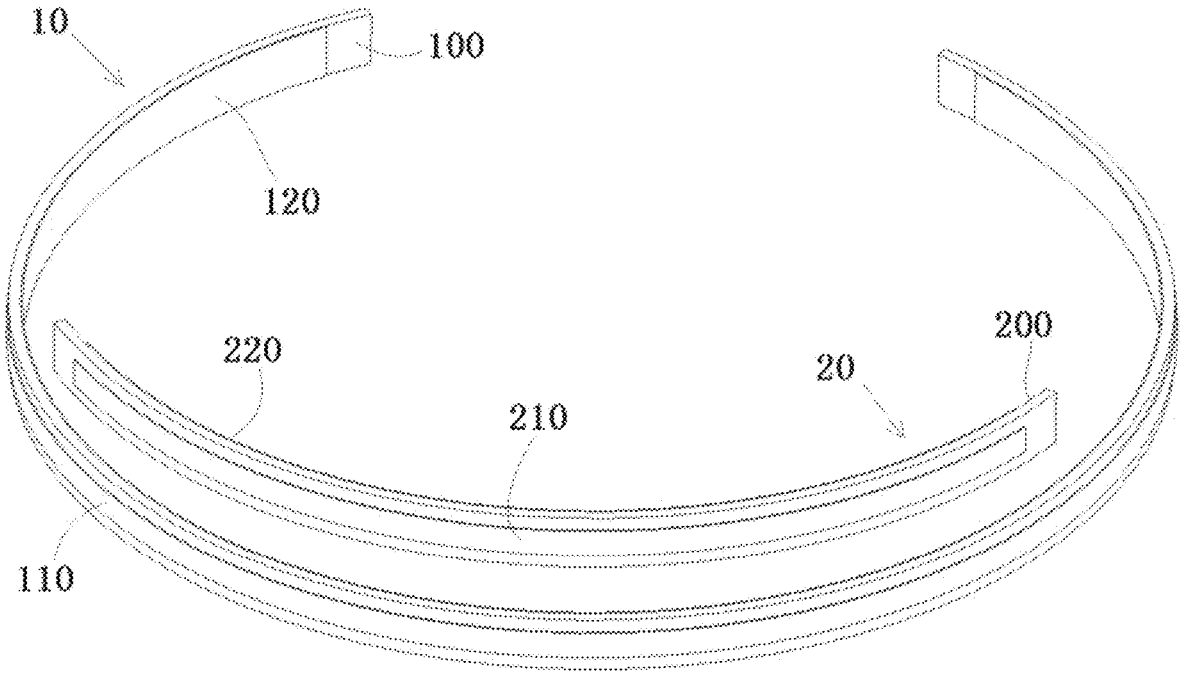
FIG. 7 is a perspective view of a wireless communication device according to another embodiment.

A wireless communication device according to another embodiment, as shown in FIG. 7, comprises a transmitting antenna 10 and a receiving antenna 20. The transmitting antenna 10 and the receiving antenna 20 are arranged to have a common central axis Z. The transmitting antenna 10 and the receiving antenna 20 are axially spaced by a predetermined distance. At least one of the transmitting antenna 10 and the receiving antenna 20 is arranged to rotate freely around the common central axis Z.

As shown in FIG. 7, in an embodiment, an outer diameter of the transmitting antenna 10 is substantially equal to an outer diameter of the receiving antenna 20, and an inner diameter of the transmitting antenna 10 is substantially equal to an inner diameter of the receiving antenna 20. In other embodiments, the outer diameter of the transmitting antenna 10 may be slightly smaller or slightly larger than the outer diameter of the receiving antenna 20, and the inner diameter of the transmitting antenna 10 may be slightly smaller or slightly larger than the inner diameter of the receiving antenna 20.

As shown in FIG. 7, in an embodiment, the transmitting antenna 10 has a first cylindrical substrate 100, a first arc-shaped outer metal strip 110, and a first arc-shaped inner metal strip 120. The cross section of the first cylindrical substrate 100 is formed as an arc with a center angle less than 360 degrees. The first arc-shaped outer metal strip 110 is formed on an outer surface 101 of the first cylindrical substrate 100. The first arc-shaped inner metal strip 120 is formed on an inner surface 102 of the first cylindrical substrate 100.

As shown in FIG. 7, in an embodiment, the first cylindrical substrate 100, the first arc-shaped outer metal strip 110, and the first arc-shaped inner metal strip 120 have a common central axis Z. A first end 111 of the first arc-shaped outer metal strip 110 is configured to electrically connect to one of an outer conductor and an inner conductor of a first RF coaxial cable (not shown), and a second end 112 of the first arc-shaped outer metal strip 110 is configured to electrically connect to a first end of a first RF resistance (not shown). A first end 121 of the first arc-shaped inner metal strip 120 is configured to electrically connect to the other of the outer conductor and the inner conductor of the first RF coaxial cable, and a second end 122 of the first arc-shaped inner metal strip 120 is configured to electrically connect to a second end of the first RF resistance.

In an embodiment, the first cylindrical substrate 100 is made of a medium material. The first cylindrical substrate 100 is configured to be a circuit board, the first arc-shaped outer metal strip 110 and the first arc-shaped inner metal strip 120 are each configured to be a metal microstrip transmission line printed on the circuit board.

As shown in FIG. 7, in an embodiment, a center angle of the first arc-shaped outer metal strip 110 is substantially equal to a center angle of the first arc-shaped inner metal strip 120.

As shown in FIG. 7, in an embodiment, one of the first arc-shaped outer metal strip 110 and the first arc-shaped inner metal strip 120 is used as a first radio frequency ground line, and the other of the first arc-shaped outer metal strip 110 and the first arc-shaped inner metal strip 120 is used as a first radio frequency signal line. An end of the first radio frequency ground line is configured to electrically connect to the outer conductor of the first RF coaxial cable, and an end of the first radio frequency signal line is configured to electrically connect to the inner conductor of the first RF coaxial cable.

In the embodiment shown in FIG. 7, the first arc-shaped outer metal strip 110 is used as the first radio frequency ground line, and the first arc-shaped inner metal strip 120 is used as the first radio frequency signal line. A width of the first radio frequency ground line is larger than that of the first radio frequency signal line. In an exemplary embodiment, the width of the first radio frequency ground line may be larger than 3 mm, and the width of the first radio frequency signal line may be less than 3 mm.

As shown in FIG. 7, in an embodiment, the transmitting antenna 10 is configured to be a Near Field Communication antenna.

As shown in FIG. 7, in an embodiment, the receiving antenna 20 comprises a second cylindrical substrate 200, a second arc-shaped outer metal strip 210, and a second arc-shaped inner metal strip 220. The cross section of the second cylindrical substrate 200 is formed as an arc with a center angle less than 360 degrees. The second arc-shaped outer metal strip 210 is formed on an outer surface 201 of the second cylindrical substrate 200. The second arc-shaped inner metal strip 220 is formed on an inner surface 202 of the second cylindrical substrate 200. In the shown embodiment, the center angle of the second arc-shaped outer metal strip 210 is substantially equal to the center angle of the second arc-shaped inner metal strip 220.

As shown in FIG. 7, in an embodiment, the second cylindrical substrate 200, the second arc-shaped outer metal strip 210, and the second arc-shaped inner metal strip 220 have a common central axis Z. A first end 211 of the second arc-shaped outer metal strip 210 is configured to electrically connect to one of an outer conductor and an inner conductor of a second RF coaxial cable (not shown), and a second end 212 of the second arc-shaped outer metal strip 210 is configured to electrically connect to a first end of a second RF resistance (not shown). A first end 221 of the second arc-shaped inner metal strip 220 is configured to electrically connect to the other of the outer conductor and the inner conductor of the second RF coaxial cable, and a second end 222 of the second arc-shaped inner metal strip 220 is configured to electrically connect to a second end of the second RF resistance.

In the embodiment shown in FIG. 7, the second cylindrical substrate 200 is configured to be a circuit board, and the second arc-shaped outer metal strip 210 and the second arc-shaped inner metal strip 220 are each configured to be a metal microstrip transmission line printed on the circuit board.

As shown in FIG. 7, in an embodiment, one of the second arc-shaped outer metal strip 210 and the second arc-shaped inner metal strip 220 is used as a second radio frequency ground line, and the other of the second arc-shaped outer metal strip 210 and the second arc-shaped inner metal strip 220 is used as a second radio frequency signal line. An end of the second radio frequency ground line is configured to electrically connect to the outer conductor of the second RF coaxial cable, and an end of the second radio frequency signal line is configured to electrically connect to the inner conductor of the second RF coaxial cable.

In the embodiment shown in FIG. 7, the second arc-shaped outer metal strip 210 is used as the second radio frequency ground line, and the second arc-shaped inner metal strip 220 is used as the second radio frequency signal line. The width of the second radio frequency ground line is larger than the width of the second radio frequency signal line. In an exemplary embodiment, the width of the second radio frequency ground line may be larger than 3 mm, and the width of the second radio frequency signal line may be less than 3 mm.

As shown in FIG. 7, in an embodiment, the receiving antenna 20 is configured to be a Near Field Communication antenna.

As shown in FIG. 7, in an embodiment, the center angle of the first arc-shaped outer metal strip 110 and the first arc-shaped inner metal strip 120 on the transmitting antenna 10 is larger than the center angle of the second arc-shaped outer metal strip 210 and the second arc-shaped inner metal strip 220 on the receiving antenna 20, respectively. In order to ensure that the signal intensity between the transmitting antenna 10 and the receiving antenna 20 remains unchanged, during rotation of at least one of the transmitting antenna 10 and the receiving antenna 20 around the common central axis Z, the second arc-shaped outer metal strip 210 and the second arc-shaped inner metal strip 220 are completely located within a fan region defined by the first arc-shaped outer metal strip 110 and the first arc-shaped inner metal strip 120.

In other embodiments, the center angle of the first arc-shaped outer metal strip 110 and the first arc-shaped inner metal strip 120 on the transmitting antenna 10 is less than the center angle of the second arc-shaped outer metal strip 210 and the second arc-shaped inner metal strip 220 on the receiving antenna 20. In this case, in order to ensure that the signal intensity between the transmitting antenna 10 and the receiving antenna 20 remains unchanged, during rotation of at least one of the transmitting antenna 10 and the receiving antenna 20 around the common central axis Z, the first arc-shaped outer metal strip 110 and the first arc-shaped inner metal strip 120 are completely located within a fan region defined by the second arc-shaped outer metal strip 210 and the second arc-shaped inner metal strip 220.

In the foregoing embodiments of the present disclosure, the near-field communication antenna (NFC antenna) generally refers to the coil antenna working at 13.56 MHz.

In the wireless communication device according to the above-described embodiments, when one of the transmitting antenna 10 and the receiving antenna 20 is rotated relative to the other, a distance between them is constant and is not changed. Therefore, it may still ensure the signal intensity and quality without increasing the signal transmission power. Moreover, because it is not necessary to increase the signal transmission power, the far-field radiation energy is very low, which may effectively prevent the signal from being leaked to the surrounding environment and tapped by others, improving the communication security.

Figure 8:
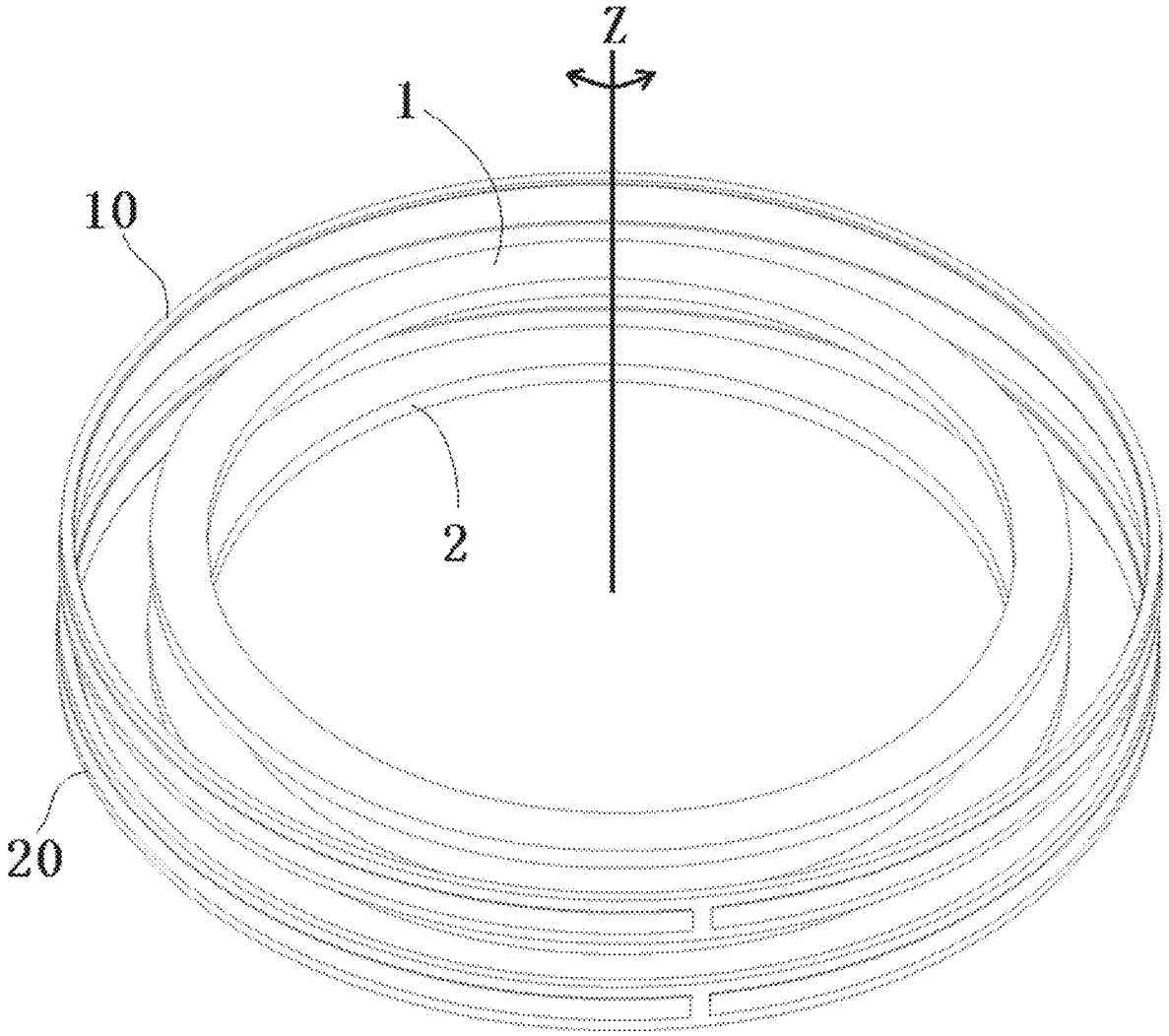
FIG. 8 is a perspective view of a combination device including the wireless communication device of FIG. 1 and a wireless power supply device according to an embodiment.

As shown in FIG. 8, in an embodiment, a combination device includes the wireless communication device shown in FIG. 1 and a wireless power supply device. The wireless power supply device comprises a transmitting coil 1 and a receiving coil 2 adapted to be electromagnetic coupled with the transmitting coil 1.

As shown in FIG. 8, in an embodiment, the transmitting antenna 10 and the receiving antenna 20 of the wireless communication device, and the transmitting coil 1 and the receiving coil 2 of the wireless power supply device have a common central axis Z, and are arranged to rotate around the common central axis Z. In the embodiment shown in FIG. 8, the wireless power supply device is arranged inside or outside the wireless communication device and is radially separated from the wireless communication device.

Figure 9:
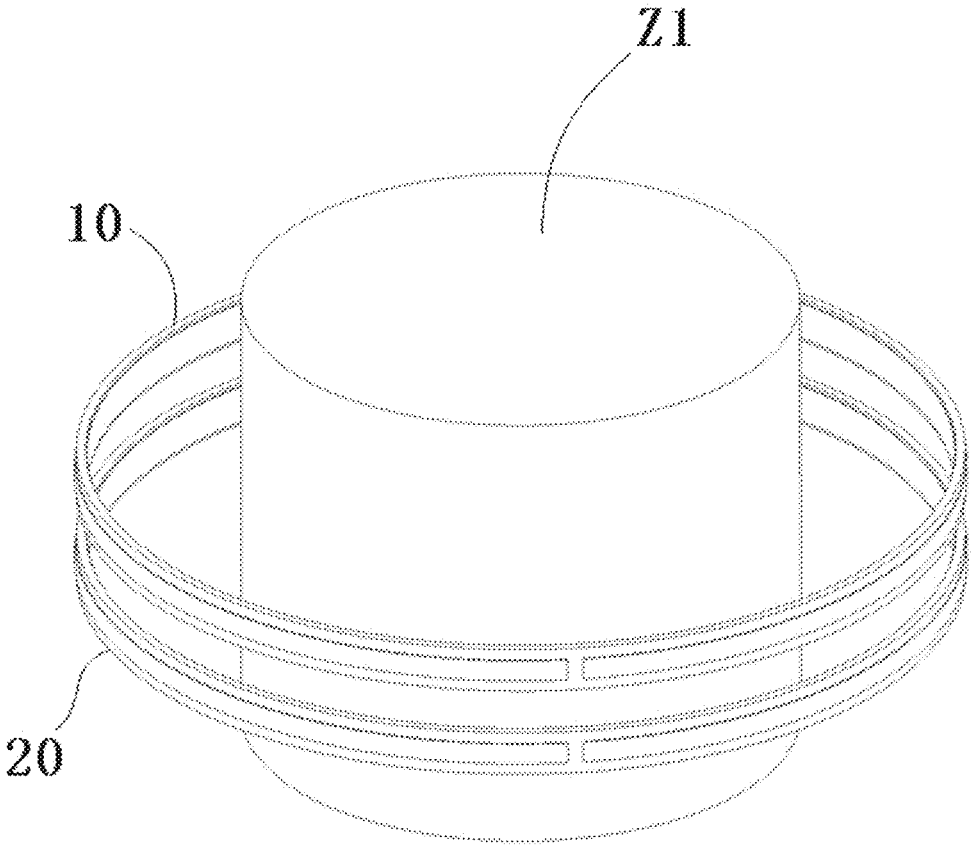
FIG. 9 is a perspective view of the wireless communication device of FIG. 1 around a common metal shaft.

In the foregoing embodiments, it is described that the wireless communication device and the wireless power supply device may be rotated around the common central axis. In other embodiments, as shown in FIG. 9, a metal shaft Z1 may be provided in the wireless communication device and the wireless power supply device. The metal shaft Z1 is located in the center of the wireless communication device and the wireless power supply device and extends along the common central axis of the wireless communication device and the wireless power supply device. In this way, the transmitting antenna 10 and the receiving antenna 20 of the wireless communication device and the transmitting coil 1 and the receiving coil 2 of the wireless power supply device may be rotated around the metal shaft Z1.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An antenna, comprising:

a cylindrical substrate, a cross section of the cylindrical substrate forms a complete circle with a center angle equal to 360 degrees or forms an arc with a center angle less than 360 degrees;

an arc-shaped outer metal strip formed on an outer surface of the cylindrical substrate, a first end of the arc-shaped outer metal strip is electrically connected to one of an outer conductor and an inner conductor of a radio frequency ("RF") coaxial cable, and a second end of the arc-shaped outer metal strip is electrically connected to a first end of a RF resistance; and an arc-shaped inner metal strip formed on an inner surface of the cylindrical substrate, the cylindrical substrate, the arc-shaped outer metal strip, and the arc-shaped inner metal strip have a common central axis, a first end of the arc-shaped inner metal strip is electrically connected to the other of the outer conductor and the inner conductor of the RF coaxial cable, and a second end of the arc-shaped inner metal strip is electrically connected to a second end of the RF resistance.

2. The antenna of claim 1, wherein the cylindrical substrate is a circuit board, the arc-shaped outer metal strip and the arc-shaped inner metal strip are each a metal microstrip transmission line printed on the circuit board.

3. The antenna of claim 1, wherein the cylindrical substrate is made of a medium material, the arc-shaped outer metal strip and the arc-shaped inner metal strip are each a metal microstrip transmission line printed on the medium material.

4. The antenna of claim 1, wherein the cross section of the cylindrical substrate is the complete circle with the center angle equal to 360 degrees, the center angle of the arc-shaped outer metal strip and the arc-shaped inner metal strip is larger than 300 degrees and less than 360 degrees.

5. The antenna of claim 1, the cross section of the cylindrical substrate is the arc with the center angle less than 360 degrees, the center angle of the arc-shaped outer metal strip and the arc-shaped inner metal strip is less than or equal to the center angle of the cross section of the cylindrical substrate.

6. The antenna of claim 1, wherein one of the arc-shaped outer metal strip and the arc-shaped inner metal strip is a radio frequency ground line, and the other of the arc-shaped outer metal strip and the arc-shaped inner metal strip is a radio frequency signal line, an end of the radio frequency ground line is electrically connected to the outer conductor of the RF coaxial cable, and an end of the radio frequency signal line is electrically connected to the inner conductor of the RF coaxial cable.

7. The antenna of claim 6, wherein a width of the radio frequency ground line is larger than a width of the radio frequency signal line.

8. The antenna of claim 7, wherein the radio frequency ground line and the radio frequency signal line are each a metal microstrip transmission line with a characteristic impedance of 50 ohms formed on the cylindrical substrate.

9. The antenna of claim 1, wherein the antenna is a near field communication antenna.

10. A wireless communication device, comprising:

a transmitting antenna including:

a first cylindrical substrate, a cross section of the first cylindrical substrate forms a complete circle with a center angle equal to 360 degrees or forms an arc with a center angle less than 360 degrees;

a first arc-shaped outer metal strip formed on an outer surface of the first cylindrical substrate, a first end of the first arc-shaped outer metal strip is electrically connected to one of an outer conductor and an inner conductor of a first radio frequency ("RF") coaxial cable, and a second end of the first arc-shaped outer metal strip is electrically connected to a first end of a first RF resistance; and a first arc-shaped inner metal strip formed on an inner surface of the first cylindrical substrate, the first cylindrical substrate, the first arc-shaped outer metal strip, and the first arc-shaped inner metal strip have a common central axis, a first end of the first arc-shaped inner metal strip is electrically connected to the other of the outer conductor and the inner conductor of the first RF coaxial cable, and a second end of the first arc-shaped inner metal strip is electrically connected to a second end of the first RF resistance; and a receiving antenna sharing the common central axis with the transmitting antenna and axially spaced from the transmitting antenna by a predetermined distance, at least one of the transmitting antenna and the receiving antenna is arranged to rotate freely around the common central axis, the receiving antenna including:

a second cylindrical substrate, a cross section of the second cylindrical substrate forms a complete circle with a center angle equal to 360 degrees or forms an arc with a center angle less than 360 degrees;

a second arc-shaped outer metal strip formed on an outer surface of the second cylindrical substrate, a first end of the second arc-shaped outer metal strip is electrically connected to one of an outer conductor and an inner conductor of a second RF coaxial cable, and a second end of the second arc-shaped outer metal strip is electrically connected to a first end of a second RF resistance; and a second arc-shaped inner metal strip formed on an inner surface of the second cylindrical substrate, the second cylindrical substrate, the second arc-shaped outer metal strip, and the second arc-shaped inner metal strip have the common central axis, a first end of the second arc-shaped inner metal strip is electrically connected to the other of the outer conductor and the inner conductor of the second RF coaxial cable, and a second end of the second arc-shaped inner metal strip is electrically connected to a second end of the second RF resistance.

11. The wireless communication device of claim 10, wherein a center angle of the first arc-shaped outer metal strip is equal to a center angle of the first arc-shaped inner metal strip, and a center angle of the second arc-shaped outer metal strip is equal to a center angle of the second arc-shaped inner metal strip.

12. The wireless communication device of claim 11, wherein the center angle of the first arc-shaped outer metal strip and the first arc-shaped inner metal strip is equal to the center angle of the second arc-shaped outer metal strip and the second arc-shaped inner metal strip.

13. The wireless communication device of claim 11, the center angle of the first arc-shaped outer metal strip and the first arc-shaped inner metal strip is less than the center angle of the second arc-shaped outer metal strip and the second arc-shaped inner metal strip.

14. The wireless communication device of claim 13, wherein, during rotation of the at least one of the transmitting antenna and the receiving antenna around the common central axis, the first arc-shaped outer metal strip and the first arc-shaped inner metal strip are completely located within a fan region defined by the second arc-shaped outer metal strip and the second arc-shaped inner metal strip.

15. The wireless communication device of claim 11, wherein the center angle of the first arc-shaped outer metal strip and the first arc-shaped inner metal strip is greater than the center angle of the second arc-shaped outer metal strip and the second arc-shaped inner metal strip.

16. The wireless communication device of claim 15, wherein, during rotation of the at least one of the transmitting antenna and the receiving antenna around the common central axis, the second arc-shaped outer metal strip and the second arc-shaped inner metal strip are completely located within a fan region defined by the first arc-shaped outer metal strip and the first arc-shaped inner metal strip.

17. A wireless communication and wireless power supply combination device, comprising:

a wireless communication device including:

a transmitting antenna having:

a first cylindrical substrate, a cross section of the first cylindrical substrate forms a complete circle with a center angle equal to 360 degrees or forms an arc with a center angle less than 360 degrees;

a first arc-shaped outer metal strip formed on an outer surface of the first cylindrical substrate, a first end of the first arc-shaped outer metal strip is electrically connected to one of an outer conductor and an inner conductor of a first radio frequency ("RF") coaxial cable, and a second end of the first arc-shaped outer metal strip is electrically connected to a first end of a first RF resistance; and a first arc-shaped inner metal strip formed on an inner surface of the first cylindrical substrate, the first cylindrical substrate, the first arc-shaped outer metal strip, and the first arc-shaped inner metal strip have a common central axis, a first end of the first arc-shaped inner metal strip is electrically connected to the other of the outer conductor and the inner conductor of the first RF coaxial cable, and a second end of the first arc-shaped inner metal strip is electrically connected to a second end of the first RF resistance; and a receiving antenna sharing the common central axis with the transmitting antenna and axially spaced from the transmitting antenna by a predetermined distance, at least one of the transmitting antenna and the receiving antenna is arranged to rotate freely around the common central axis, the receiving antenna having:

a second cylindrical substrate, a cross section of the second cylindrical substrate forms a complete circle with a center angle equal to 360 degrees or forms an arc with a center angle less than 360 degrees;

a second arc-shaped outer metal strip formed on an outer surface of the second cylindrical substrate, a first end of the second arc-shaped outer metal strip is electrically connected to one of an outer conductor and an inner conductor of a second RF coaxial cable, and a second end of the second arc-shaped outer metal strip is electrically connected to a first end of a second RF resistance; and a second arc-shaped inner metal strip formed on an inner surface of the second cylindrical substrate, the second cylindrical substrate, the second arc-shaped outer metal strip, and the second arc-shaped inner metal strip have the common central axis, a first end of the second arc-shaped inner metal strip is electrically connected to the other of the outer conductor and the inner conductor of the second RF coaxial cable, and a second end of the second arc-shaped inner metal strip is electrically connected to a second end of the second RF resistance; and a wireless power supply device including a transmitting coil and a receiving coil electromagnetically coupled with the transmitting coil, the transmitting antenna and the receiving antenna of the wireless communication device and the transmitting coil and the receiving coil of the wireless power supply device share the common central axis and are arranged to rotate around the common central axis.

18. The wireless communication and wireless power supply combination device of claim 17, wherein the wireless power supply device is arranged inside or outside the wireless communication device and is radially separated from the wireless communication device.

19. The wireless communication and wireless power supply combination device of claim 17, further comprising a metal shaft located in a center of the wireless communication device and the wireless power supply device and extending along the common central axis.

20. The wireless communication and wireless power supply combination device of claim 19, wherein the transmitting antenna and the receiving antenna of the wireless communication device, and the transmitting coil and the receiving coil of the wireless power supply device are arranged to rotate around the metal shaft.

* * * * *